US012240668B2

(12) United States Patent
Yamamoto

(10) Patent No.: US 12,240,668 B2
(45) Date of Patent: Mar. 4, 2025

(54) BARRIER CAP

(71) Applicant: YOSHINO KOGYOSHO CO., LTD., Tokyo (JP)

(72) Inventor: Manabu Yamamoto, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 540 days.

(21) Appl. No.: 17/613,150

(22) PCT Filed: Apr. 15, 2020

(86) PCT No.: PCT/JP2020/016633

§ 371 (c)(1),
(2) Date: Nov. 22, 2021

(87) PCT Pub. No.: WO2020/235273

PCT Pub. Date: Nov. 26, 2020

(65) Prior Publication Data

US 2022/0219871 A1 Jul. 14, 2022

(30) Foreign Application Priority Data

May 23, 2019 (JP) ..... 2019-096850

(51) Int. Cl.
*B65D 51/22* (2006.01)
*B65D 47/36* (2006.01)

(52) U.S. Cl.
CPC ..... *B65D 51/228* (2013.01); *B65D 47/36* (2013.01); *B65D 2251/0028* (2013.01); *B65D 2251/0093* (2013.01)

(58) Field of Classification Search
CPC ..... B65D 51/228; B65D 47/36; B65D 2251/0093; B65D 2251/009; B65D 2251/0062; B65D 51/223; B65D 51/222
See application file for complete search history.

(56) References Cited

U.S. PATENT DOCUMENTS 3,401,819 A * 9/1968 Salamone ..... B65D 51/222 D9/454
4,157,765 A * 6/1979 Golebiewsky ..... B65D 51/222 222/81

(Continued)

FOREIGN PATENT DOCUMENTS

JP 2013-056688 A 3/2013
JP 2015-227194 A 12/2015

(Continued)

OTHER PUBLICATIONS

Nov. 7, 2022 Office Action issued in Chinese Patent Application No. 202080038280.9.

(Continued)

*Primary Examiner* — Nathan J Jenness
*Assistant Examiner* — Jennifer Castriotta
(74) *Attorney, Agent, or Firm* — Oliff PLC

(57) ABSTRACT

A barrier cap including a cap main body configured to be fitted onto a mouth of a container main body and an upper lid configured to be fitted onto the cap main body, the barrier cap being configured to be openable, wherein the cap main body includes a base layer and a barrier layer provided as an intermediate layer in the base layer, the base layer including a base resin, and the barrier layer containing a barrier resin, and the barrier layer includes a blend of the base resin and the barrier resin.

1 Claim, 4 Drawing Sheets

(56) References Cited

U.S. PATENT DOCUMENTS

| | | | | |
|---|---|---|---|---|
| 2004/0011697 | A1* | 1/2004 | Fontana | B65D 51/228<br>206/823 |
| 2014/0030500 | A1* | 1/2014 | Sandkuehler | B32B 27/08<br>264/173.13 |
| 2021/0284404 | A1* | 9/2021 | Danielsson | B65D 47/123 |
| 2022/0112018 | A1* | 4/2022 | Montano | B65D 65/40 |

FOREIGN PATENT DOCUMENTS

| | | | |
|---|---|---|---|
| JP | 2018-002224 | A | 1/2018 |
| JP | 2019-031325 | A | 2/2019 |

OTHER PUBLICATIONS

Jan. 5, 2023 Extended Search Report issued in European Patent Application No. 20809740.2.
Jan. 24, 2023 Office Action issued in Japanese Patent Application No. 2019-096850.
Feb. 16, 2023 Office Action issued in Chinese Patent Application No. 202080038280.9.
Nov. 16, 2021 International Preliminary Report on Patentability issued in International Application No. PCT/JP2020/016633.
May 8, 2023 Office Action Issued in Chinese Patent Application No. 202080038280.9.
Jun. 23, 2020 International Search Report issued in International Patent Application No. PCT/JP2020/016633.

* cited by examiner

BARRIER CAP

TECHNICAL FIELD

This application relates to an openable cap, in particular to a barrier cap that has excellent barrier properties.

BACKGROUND

Openable caps have been widely used in food containers containing dressings, seasonings, or the like in order to seal the insides of the containers until they are opened. Such an openable cap includes a cap main body that is fitted onto a mouth of a container and that is provided with a partition wall with a removable portion defined by a reduced-thickness weakened portion, and by pulling up a pull ring provided in the removable portion, the removable portion is torn off, and the dispensing spout is opened.

Further, containers having excellent gas barrier properties to oxygen or the like in the air surrounding the containers have been proposed for retaining flavors of the contents, and caps having correspondingly excellent gas barrier properties are known (for example, Patent Literature [PTL] 1).

CITATION LIST

Patent Literature

PTL 1: JP 2015-227194 A

SUMMARY

Technical Problems

A cap disclosed in PTL 1 above is provided with gas barrier properties, by coating a lower surface of the partition wall in which the removable portion is formed with a barrier film layer including laminated barrier layers. One problem caused by poor rupture properties of the barrier layers is that it is necessary to provide a blind slit in the laminated barrier film layer in the vicinity of a base end portion of a connection piece used to connect a pull ring, so as to improve its openability.

Further, because the laminated barrier film layer is a laminated layer including barrier layers and a polyethylene (linear low-density polyethylene) layer, which have poor adhesion properties to each other, another problem is that it is necessary to provide an additional adhesion layer.

It would be helpful to provide a barrier cap with excellent gas barrier properties that includes a barrier layer provided as an intermediate layer in a cap main body, wherein the barrier layer has excellent rupture properties even when there is no blind slit provided to improve the openability and also has excellent adhesion properties to a resin constituting the cap main body.

Solution to Problems

One aspect of the present disclosure resides in a barrier cap including a cap main body configured to be fitted onto a mouth of a container main body and an upper lid configured to be fitted onto the cap main body, the barrier cap being configured to be openable, wherein the cap main body includes a base layer and a barrier layer provided as an intermediate layer in the base layer, the base layer including a base resin, and the barrier layer containing a barrier resin, and the barrier layer includes a blend of the base resin and the barrier resin.

In an embodiment of the barrier cap, the barrier layer includes linear low-density polyethylene as the base resin, and ethylene vinyl alcohol copolymer with an ethylene content of 27 to 44 mol % as the barrier resin, and the blending ratio of linear low-density polyethylene is greater than or equal to 5%, and moreover, the blending ratio of linear low-density polyethylene in the barrier layer is 5 to 25%

In another embodiment of the barrier cap, the barrier layer is provided to cover the entire opening of the mouth of the container main body, and moreover, the cap main body includes a fitting portion configured to be fitted onto the container main body, a dispensing tube provided to stand on an inner side of the fitting portion, and a partition wall provided in the dispensing tube and including a removable portion defined by a reduced-thickness weakened portion, and the barrier layer is provided at least in the fitting portion and the partition wall, including the reduced-thickness weakened portion and the removable portion.

In still another embodiment of the barrier cap, the barrier cap is configured to be openable with a pull ring.

In still another embodiment of the barrier cap, the upper lid is configured to be detachably screw-fitted onto the cap main body, and the cap main body includes a displaceable stopper configured to be ruptured and displaced to the upper lid when the upper lid is rotated.

Advantageous Effect

In the barrier cap according to the present disclosure, the barrier layer is provided as the intermediate layer in the cap main body, and a blend of the base resin, which constitutes the base layer of the cap main body, and the barrier resin is used to form the barrier layer. Accordingly, adhesion properties between the base layer and the barrier layer are enhanced, excellent barrier properties are provided, and cap opening can be performed without difficulty.

In particular, when a blend of linear low-density polyethylene, which is used as the base resin constituting the cap main body, and ethylene vinyl alcohol copolymer with an ethylene content of 27 to 44 mol %, which is used as the barrier resin, is used, and when the blending ratio of linear low-density polyethylene is greater than or equal to 5%, adhesion properties between the base layer of the cap main body and the barrier layer are enhanced, and rupture properties of the reduced-thickness weakened portion are improved.

DETAILED DESCRIPTION

Hereinafter, a barrier cap according to the present disclosure is described with reference to the drawings illustrating a specific example.

EXAMPLE

Figure 1:
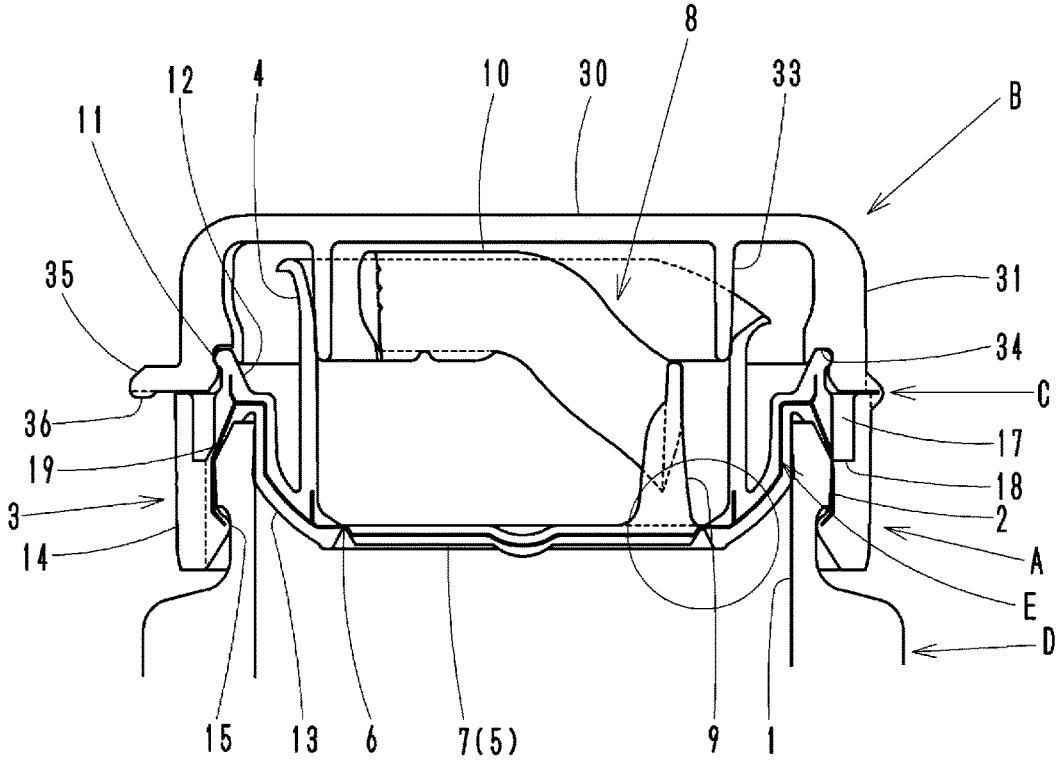
FIG. 1 is a sectional side view illustrating a barrier cap in a closed state according to an example of the present disclosure.

In FIG. 1, reference numeral A denotes a cap main body that is fitted onto a container main body D, and B denotes an upper lid that is integrally molded with the cap main body A via a hinge C.

The container main body D includes a mouth 1 having an outer circumference provided with an engagement ridge 2.

Further, as illustrated in FIG. 1, the cap main body A includes a fitting portion 3 fitted onto the container main body D, a dispensing tube 4 provided to stand on an inner edge lower end of the fitting portion 3, and a partition wall 5 provided in the dispensing tube 4.

The partition wall 5 is provided with a removable portion 7 defined by a reduced-thickness weakened portion 6, which can be ruptured so as to open a spout before use. The removable portion 7 is provided, on an upper surface thereof, with a pull ring 8 used when it is opened.

The pull ring 8 includes a column portion 9 provided to stand on an end portion thereof closer to the hinge C, and a ring portion 10 provided contiguously to an upper end of the column portion 9.

The fitting portion 3 includes an annular lid engagement portion 12 that is provided on a peripheral edge thereof with a locking ridge 11 to engage with the upper lid B, an inner tube 13 provided to be suspended from the inner circumferential side of the lid engagement portion 12, and an outer peripheral wall portion 14 provided to be suspended from the outer circumferential side of the lid engagement portion 12.

The outer peripheral wall portion 1 is provided, in an inner peripheral lower portion thereof, with an engagement protrusion 15 to engage with the container main body D.

Figure 3A:
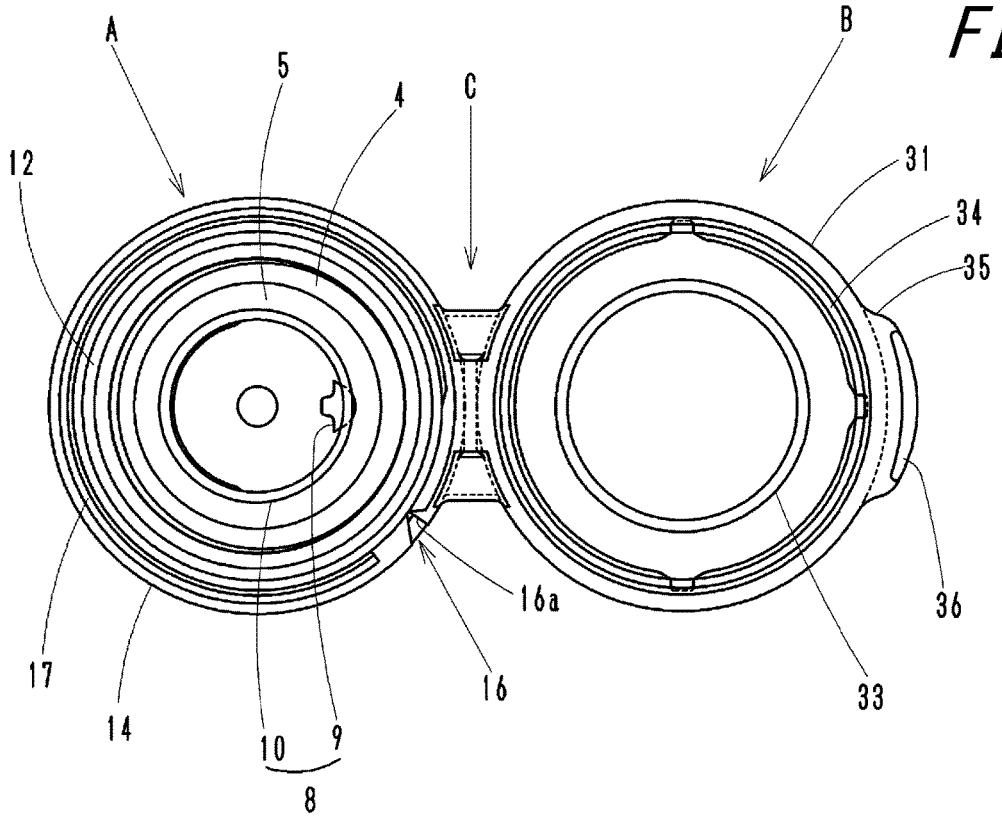
FIG. 3A is a top view illustrating the barrier cap in an open state according to the example.

As illustrated in FIG. 3A, the outer peripheral wall portion 14 is provided, on an outer circumference thereof, with an outer peripheral cut portion 16 that is located on the left or right side in the vicinity of the hinge C, while a reduced-thickness bottom wall remains in a lower end portion. The outer peripheral cut portion 16 has a substantially V-shape in its plan view.

Although not illustrated, at a position of the engagement protrusion 15 that corresponds to the outer peripheral cut portion 16, an inner peripheral cut portion is provided in the vertical direction, whereby a vertical tear line is formed.

The outer peripheral cut portion 16, on its side located closer to the hinge C, has an end surface 16*a*, and a slit groove 17 circumferentially extends from a position located on an inner peripheral upper portion of the end surface 16*a* across the reduced-thickness portion. The slit groove 17 is provided as a recess extending from the upper side, and in the present example, it extends approximately 345° from the end surface 16*a*.

Further, the slit groove 17 has a bottom surface 18 that is provided, on the inner circumferential side thereof, with a reduced-thickness connection portion 19 that connects the outer peripheral wall portion 14 and the lid engagement portion 12, with a point at the slit groove 17 that is adjacent to the vertical tear line being defined as a tear start point, and a circumferential tear line thus formed extends in an arc shape, so that it can be torn to an end point which is located at a connection portion that cannot be ruptured.

Figure 3B:
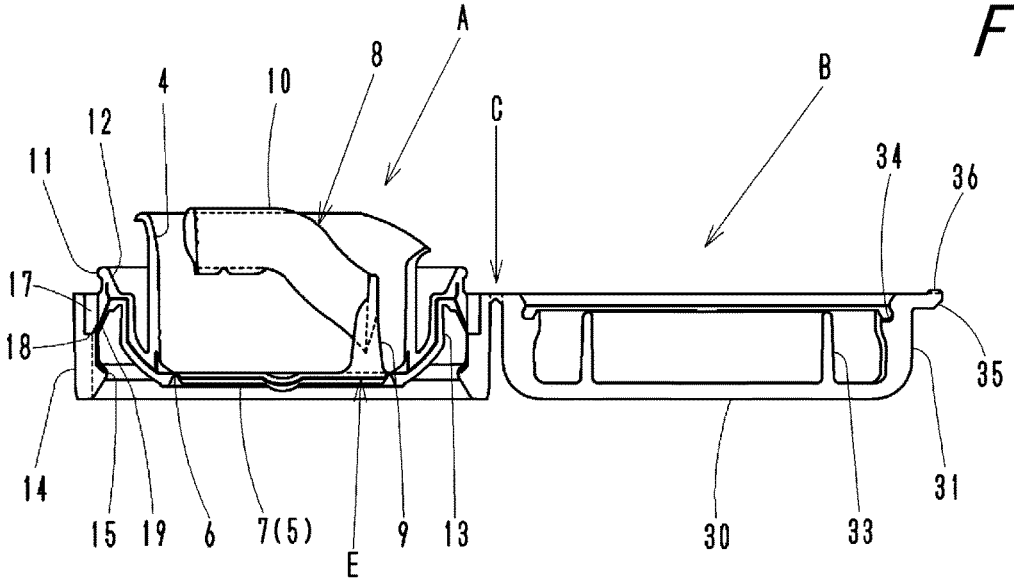
FIG. 3B is a sectional side view illustrating the barrier cap according to the example.

As illustrated in FIG. 1 and FIG. 3, the cap main body A includes a barrier layer E formed by co-injection molding as an intermediate layer with respect to a base layer of the cap main body A.

As a base resin constituting the base layer of the cap main body A, known resins, such as polyolefin resin, including polypropylene (PP) and polyethylene (PE), or PET, may be used.

As a barrier resin constituting the barrier layer E, depending on its barrier targets, known resins with gas barrier properties, such as ethylene vinyl alcohol copolymer (EVOH), polyvinyl alcohol (PVA), polyvinylidene chloride (PVDC), polyamide (PA), MX nylon (e.g., MXD6), may be used.

Above all, ethylene vinyl alcohol copolymer (EVOH) is preferable from the perspective of its barrier properties to oxygen and barrier properties for aroma and flavor retention.

As illustrated in FIG. 1, the barrier layer E is to be provided to cover the entire opening of the mouth 1 of the container main body D, so as to completely block oxygen or the like.

In the present example, the barrier layer E is provided as an intermediate layer over the fitting portion (i.e., the lid engagement portion 12, the inner tube 13, and the outer peripheral wall portion 14) of the cap main body A, the dispensing tube 4, the reduced-thickness weakened portion 6, and the partition wall 5, including the removable portion 7.

Additionally, it is not essential to provide the barrier layer E in the dispensing tube 4 and the outer peripheral wall portion 14 of the cap main body A.

Figure 2:
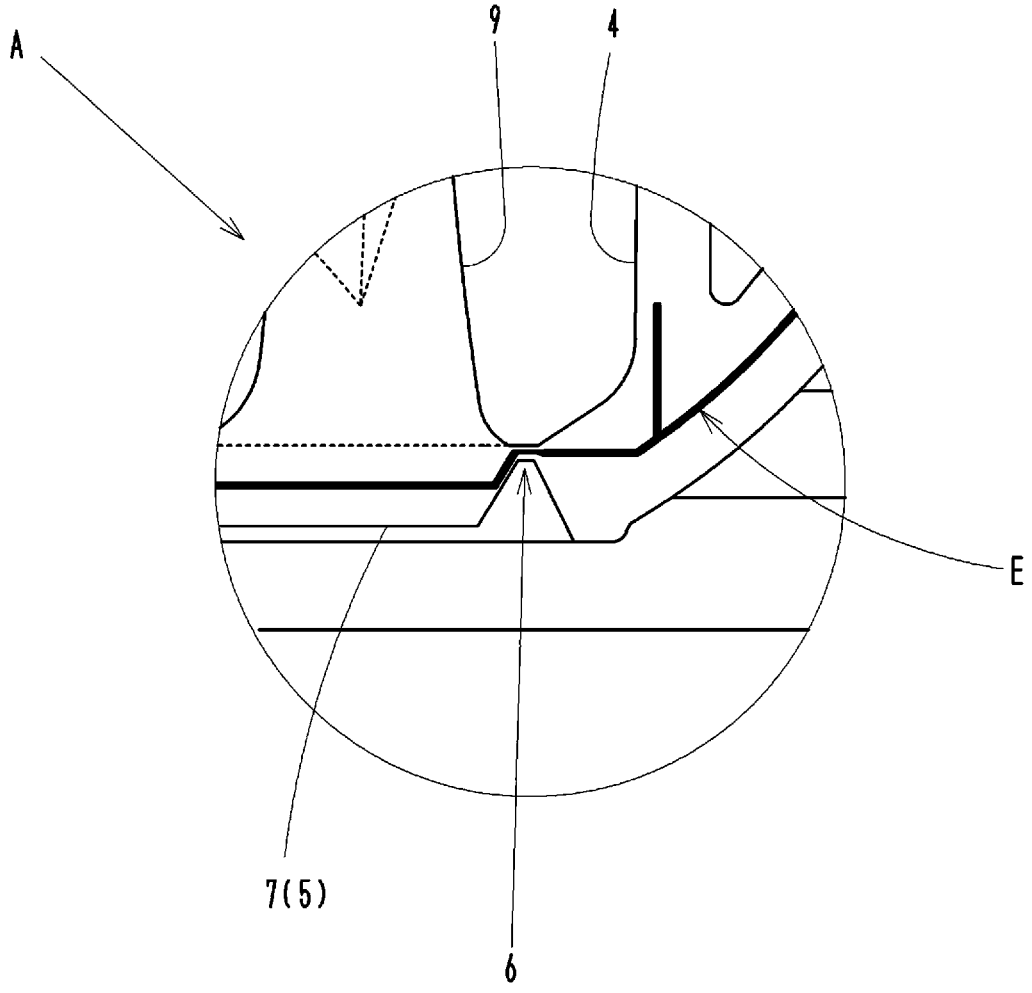
FIG. 2 is an enlarged view of a portion of FIG. 1.

Further, as illustrated in FIG. 2, the barrier layer E according to the present example is also provided in the reduced-thickness weakened portion 6. With regards to rupture of the reduced-thickness weakened portion 6, a base resin constituting the base layer of the cap main body A and a barrier resin constituting the barrier layer E generally have poor adhesion properties to each other. It is therefore sometimes the case that, even when the base layer portion of the reduced-thickness weakened portion 6 ruptures, the barrier layer E separates and cannot fully rupture, thus preventing cap opening. To address these cases, by using the barrier layer E that includes a barrier resin blended with a base resin constituting the base layer of the cap main body A, adhesion properties between the base layer and the barrier layer E can be improved, and thus making it easier to rupture the barrier layer E and enabling cap opening.

The present inventor has therefore conducted verification tests to determine how much of LLDPE, which serves as the base resin, is to be blended to form the barrier resin E in order to enable the reduced-thickness weakened portion 6 of the barrier cap according to the above example to rupture, using linear low density polyethylene (LLDPE) as a base resin constituting the base layer and using ethylene vinyl alcohol copolymer (EVOH) as a barrier resin constituting the barrier layer E.

Base resin: LLDPE (25200) manufactured by Prime Polymer Co., Ltd.)

Barrier resin: EVOH (C109B manufactured by Kuraray Co., Ltd.) with an ethylene content of 35 mol %

Oxygen permeability measurement: measurement using OX-TRAN 2/20 manufactured by MOCON, Inc.)

TABLE 1

| | | 1 | 2 | 3 | 4 | 5 | 6 |
|---|---|---|---|---|---|---|---|
| Barrier layer | EVOH (%) | 100 | 95 | 90 | 85 | 75 | 0 |
| | LLDPE (%) | 0 | 5 | 10 | 15 | 25 | 100 |
| Cap opening test | | Fail | Pass | Pass | Pass | Pass | Pass |
| Oxygen transmission rate (OTR) (cc/day · pack) | | — | — | — | 0.025 | — | 0.626 |

In Table 1 above, "fail" indicates that cap opening cannot be performed, and "pass" indicates that cap opening can be performed, and blending ratios are based on weight % (wt %).

Table 1 demonstrates that cap opening can be performed when EVOH with an ethylene content of 35 mol % is used as a barrier resin and when LLDPE is blended to form the barrier layer E with a blending ratio of greater than or equal to 5%, in particular with a blending ratio of 5 to 25%.

Further, as a result of an additional test, it has turned out that a satisfactory oxygen transmission rate is obtained, and the barrier layer E that enables cap opening is formed, when EVOH has an ethylene content of 27 to 44 mol %.

Additionally, the blending ratio at which cap opening can be performed varies depending on what types of base resin and barrier resin are respectively chosen for the base layer and the barrier layer E.

Further, as is known, when a base resin constituting the base layer is added and blended into a barrier resin, the barrier properties of the barrier layer E degrade as the blending amount the base resin increases. For this reason, it is preferable to conduct blending at the minimum blending ratio at which cap opening can be performed so as to retain the barrier properties.

Moreover, if it is difficult to mix a base resin and a barrier resin, a compatibilizer may be added as appropriate.

As illustrated in FIG. 1 and FIG. 3, the upper lid B is rotatably attached to an outer peripheral upper end of the outer peripheral wall portion 14 of the cap main body A via the hinge C. The upper lid B includes a top wall 30 provided at the top portion, and a peripheral side wall 31 provided to be suspended from an outer peripheral edge of the top wall 30.

The top wall 30 has a lower surface from which a sealing tube 33 is suspended. The sealing tube 33 is arranged so that its outer circumference abuts against an inner circumference of the dispensing tube 4.

The peripheral side wall 31 has a lower end portion that is provided, on the inner circumference side thereof, with an engagement recess 34 that engages with the locking ridge 11 of the lid engagement portion 12 of the cap main body A.

The peripheral side wall 31 is provided, at a position on an outer circumference thereof that is located opposite to the hinge C, with an arc-shaped tab handle 35 that extends in the circumferential direction. The tab handle 35 is provided, on a lower surface of a middle portion thereof, with a finger rest portion 36.

Additionally, although not illustrated, a shrink label, a sealing member, or the like is disposed between the cap main body A and the upper lid B of the barrier cap according to the present example, in order to prevent accidental cap opening before use.

Next, a mode of use and advantageous effects of the present example.

To start with, the cap main body A of the barrier cap according to the present example can be manufactured by performing co-injection molding so as to form the barrier layer E containing a barrier resin as an intermediate layer with respect to the base layer of the cap main body A that includes a base resin.

To fit the barrier cap according to the present example onto the container main body D, it is necessary to rotate the upper lid B about the hinge C, thereby switching an open lid state immediately after manufacturing as illustrated in FIG. 3 to a closed lid state as illustrated in FIG. 1.

At this time, the outer circumference of the sealing tube 33 of the upper lid B abuts against the inner circumference of the dispensing tube 4 of the cap main body A, and the engagement recess 34 of the upper lid B engages with the locking ridge 11 of the lid engagement portion 12 of the cap main body A, so that the closed lid state as illustrated in FIG. 1 is achieved.

The closed barrier cap according to the present example is fitted onto the container main body D, by placing the fitting portion 3 over the mouth 1 of the container main body D in which a content liquid has been filled at a high temperature and by pressing the barrier cap from above to plug it thereinto.

Subsequently, the container with the barrier cap according to the present example being fitted by being plugged thereinto can be used as follows. That is, by resting a finger on the tab handle 35 of the upper lid B and lifting it to thereby release engagement between the engagement recess 34 of the upper lid B and the locking ridge 11 of the cap main body A, and by rotating the upper lid B, the barrier cap is brought into the open lid state. Further, by putting fingers on the pull ring 8 and pulling it up to thereby rupture the reduced-thickness weakened portion 6 and remove the removable portion 7 for cap opening, the dispensing spout is opened. After that, by tilting the container main body D, the content liquid can be guided along the inner circumferential surface of the dispensing tube 4 and dispensed. In this way, the barrier cap according to the present example can be opened with the pull ring 8 without difficulty.

After the container is used, the barrier cap according to the present example can be detached from the container main body D and disposed of separately.

To do this, the barrier cap is to be opened, and the upper lid B is to be held with fingers and pulled outward, and then, the connection portion between the outer peripheral wall portion 14 and the hinge C is pulled and deformed, and the vertical tear line ruptures. By pulling the upper lid B further, the reduced-thickness connection portion 19, which defines the circumferential tear line, starts to rupture. As the rupture of the reduced-thickness connection portion 19 progresses, the upper lid B starts to come off from the cap main body A.

Once the rupture of the reduced-thickness connection portion 19 ends at the end point of the slit groove 17, engagement between the cap main body A and the container main body D can be released by pulling the upper lid B further. Thus, the barrier can and the container main body D can be disposed of separately.

It is to be noted that, although the barrier cap according to the present example is fitted onto the container main body D by being plugged thereinto, it can be screw-fitted. Further, although the upper lid B is provided contiguously to the cap main body A via the hinge C, the upper lid B can be screw-fitted to the cap main body A.

Figure 4:
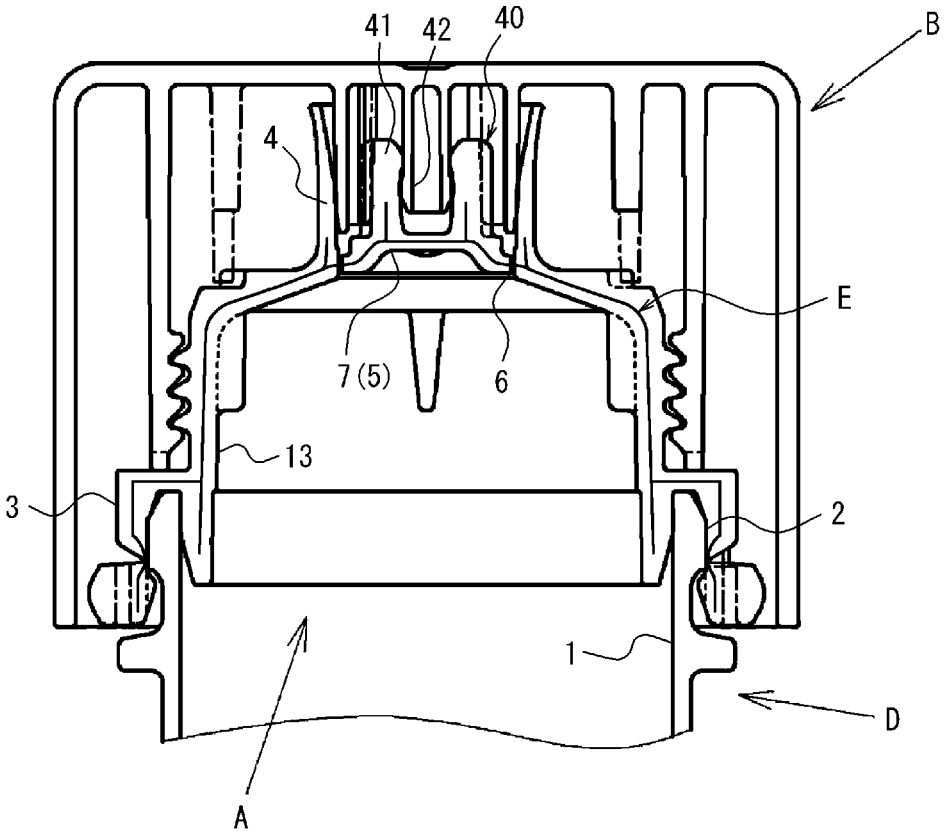
FIG. 4 is a half-sectional side view illustrating a cap main body of a barrier cap according to a modification.

As illustrated as a modification in FIG. 4, in the barrier cap according to the present example, the upper lid B can be configured to be detachably screw-fitted to the cap main body A, and the cap main body A is configured to include a displaceable stopper 40 that is ruptured and displaced to the upper lid B when the upper lid B is rotated.

In this case, the displaceable stopper 40 includes a cylindrical tubular wall 41 provided to stand in its upper portion, and also includes the removable portion 7 in its lower portion. The removable portion 7 connects to the inner tube 13 via the reduced-thickness weakened portion 6 to thereby close the dispensing tube 4. Further, the tubular wall 41 engages with a cylindrical hook portion 42 provided in the upper lid B in a manner such that tubular wall 41 is prevented from rotating. Accordingly, when the upper lid B is rotated relative to the cap main body A, the displaceable stopper 40 rotates together with the upper lid B, and the reduced-thickness weakened portion 6 ruptures, thereby opening the dispensing tube 4, and at the same time, the displaceable stopper 40 is displaced to the upper lid B. After being displaced to the upper lid B, the displaceable stopper 40, together with the upper lid B, can be removed from the cap main body A.

In the barrier cap according to the modification also, the barrier layer E including a blend of a base resin and a barrier resin is provided as an intermediate layer in the base layer of the cap main body A. Accordingly, the barrier cap according to the modification can also be opened by rotating the upper lid B without difficulty.

INDUSTRIAL APPLICABILITY

The barrier cap according to the present disclosure can be opened without difficulty, and has excellent gas barrier properties and is capable of preventing dispersion of active ingredients, because the barrier layer having gas barrier properties is provided as an intermediate layer with respect to the base layer of the cap main body. The barrier cap is therefore suited for use in gas barrier containers for food and beverages, cosmetics, or the like.

REFERENCE SIGNS LIST

| | |
|---|---|
| A | Cap main body |
| B | Upper lid |
| C | Hinge |
| D | Container main body |
| E | Barrier layer |
| 1 | Mouth |
| 2 | Engagement ridge |
| 3 | Fitting portion |
| 4 | Dispensing tube |

-continued

| | |
|---|---|
| 5 | Partition wall |
| 6 | Reduced-thickness weakened portion |
| 7 | Removable portion |
| 8 | Pull ring |
| 9 | Column portion |
| 10 | Ring portion |
| 11 | Locking ridge |
| 12 | Lid engagement portion |
| 13 | Inner tube |
| 14 | Outer peripheral wall portion |
| 15 | Engagement protrusion |
| 16 | Outer peripheral cut portion |
| 16a | End surface |
| 17 | Slit groove |
| 18 | Bottom surface |
| 19 | Reduced-thickness connection portion |
| 30 | Top wall |
| 31 | Peripheral side wall |
| 33 | Sealing tube |
| 34 | Engagement recess |
| 35 | Tab handle |
| 36 | Finger rest portion |
| 40 | Displaceable stopper |
| 41 | Tubular wall |
| 42 | Cylindrical hook portion |

The invention claimed is:

1. A barrier cap comprising a cap main body configured to be fitted onto a mouth of a container main body and an upper lid configured to be fitted onto the cap main body, the barrier cap being configured to be openable, wherein the cap main body includes a base layer and a barrier layer provided as an intermediate layer in the base layer, the base layer comprising a base resin, and the barrier layer containing a barrier resin, the barrier layer comprises a blend of the base resin and the barrier resin, and the cap main body includes a fitting portion including an outer peripheral wall portion and an inner tube and configured to be fitted onto the container main body, a dispensing tube provided to stand on an inner side of the fitting portion, and a partition wall provided in the dispensing tube and including a removable portion defined by a reduced-thickness weakened portion, the barrier layer is provided at least in (i) the outer peripheral wall portion, (ii) the inner tube, (iii) the reduced-thickness weakened portion and (iv) the removable portion, and, the barrier layer extends into the dispensing tube.

* * * * *